United States Patent [19]

Mehrens

[11] Patent Number: 4,475,306

[45] Date of Patent: Oct. 9, 1984

[54] WINDOW SILL FLOWER POT SUPPORT

[76] Inventor: Douglas W. Mehrens, 742 East Coronado Rd., Phoenix, Ariz. 85006

[21] Appl. No.: 443,465

[22] Filed: Nov. 22, 1982

[51] Int. Cl.[3] ..... A47G 4/00

[52] U.S. Cl. ..... 47/39; 248/236

[58] Field of Search ..... 47/39, 40, 67, 68; 403/107; 248/208; 211/88

[56] References Cited

U.S. PATENT DOCUMENTS

| | | | |
|---|---|---|---|
| 317,939 | 5/1885 | Halfpenny | 47/70 |
| 477,355 | 6/1892 | Curtis et al. | 211/88 |
| 557,875 | 4/1896 | Pittet | 248/236 |
| 1,224,127 | 5/1917 | Burtlett | 248/208 |
| 1,436,601 | 11/1922 | Niemeyer | 211/88 |
| 1,446,231 | 2/1923 | West | 47/68 |
| 1,558,977 | 10/1925 | Gray | 47/68 |
| 1,713,116 | 5/1929 | Curtis | 211/88 |
| 1,809,216 | 6/1931 | Quandt | 248/208 |
| 1,914,617 | 6/1933 | Rogers | 47/40 |
| 1,989,294 | 1/1935 | Serpico | 47/40 |
| 2,029,246 | 1/1936 | McCarroll | 248/208 |
| 2,063,289 | 12/1936 | Alusas | 47/40 |
| 2,152,990 | 4/1939 | Fader et al. | 47/68 |
| 2,544,203 | 3/1951 | Watkins | 248/236 |
| 2,588,596 | 3/1952 | Weber | 47/39 |
| 3,007,616 | 11/1961 | Zuckerman | 403/107 |
| 3,946,522 | 3/1976 | Schifman | 47/40 |

FOREIGN PATENT DOCUMENTS

| | | | |
|---|---|---|---|
| 109796 | 2/1940 | Australia | 403/107 |
| 60951 | 5/1943 | Denmark | 47/67 |
| 344246 | 11/1919 | Fed. Rep. of Germany | 47/39 |
| 399415 | 10/1942 | Italy | 403/107 |
| 336173 | 3/1959 | Switzerland | 47/39 |

*Primary Examiner*—James R. Feyrer

*Attorney, Agent, or Firm*—Warren F. B. Lindsley

[57] ABSTRACT

A flower pot support for securing to a narrow window sill, which support extends outwardly of the sill in a cantilever manner, and employs a weight transfer leg which engages at its free end the wall of the building below the sill.

2 Claims, 21 Drawing Figures

FIG. 8
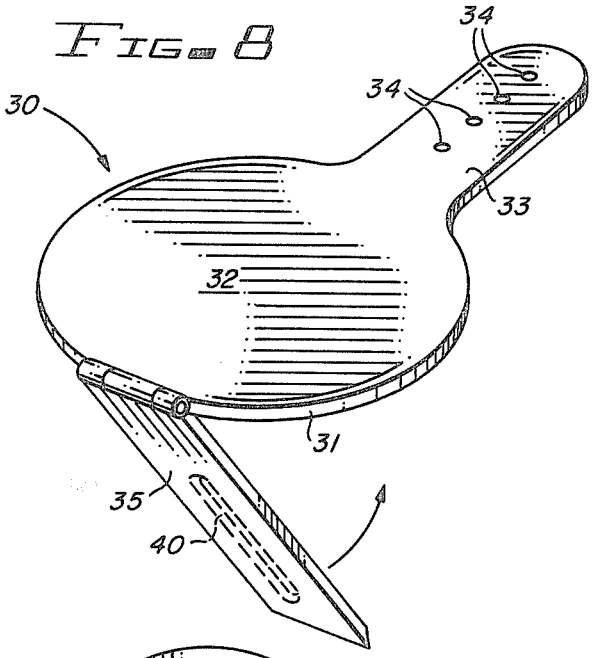
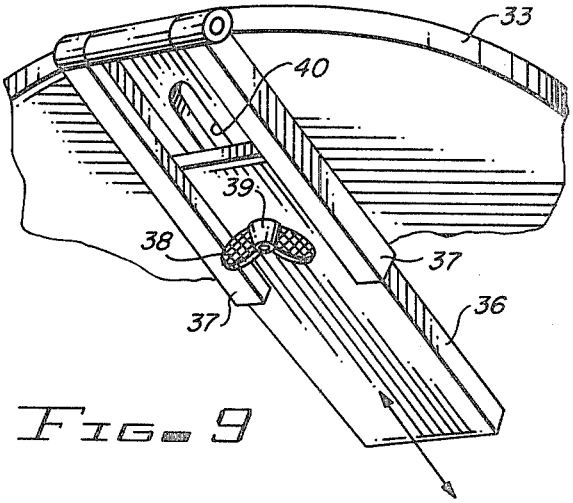
FIG. 9
FIG. 11
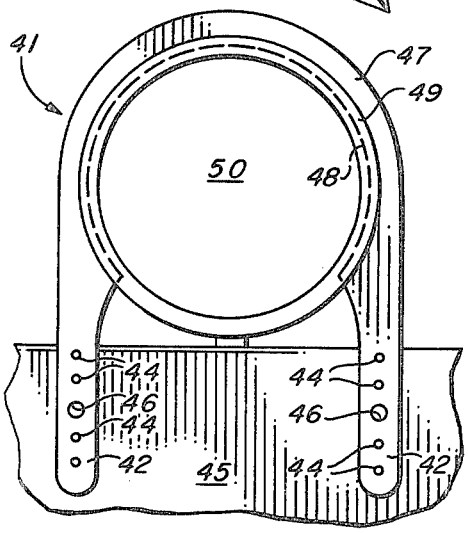
FIG. 10
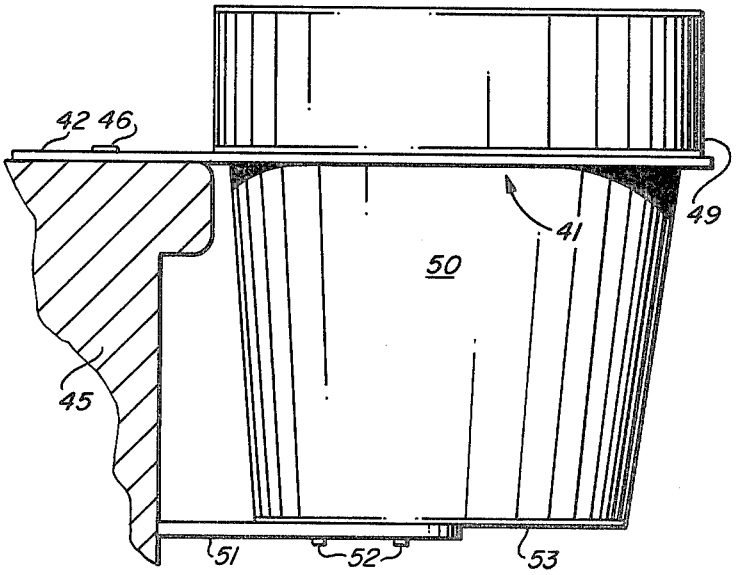
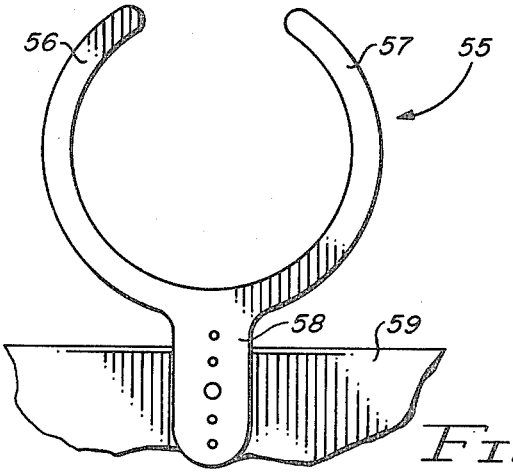
FIG. 13
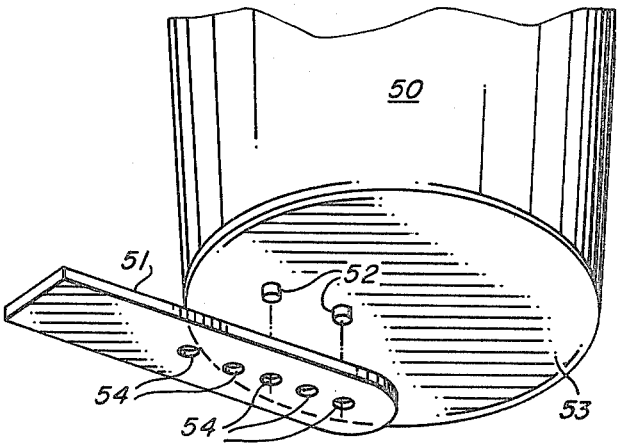
FIG. 12

WINDOW SILL FLOWER POT SUPPORT

BACKGROUND OF THE INVENTION

This invention relates to planters and, more particularly, to means for supporting wall and window sill mounted plant growth.

1. Field of the Invention

This invention is particularly directed to a means for supporting a flower pot on or from a narrow ledge or window sill of a building.

2. Description of the Prior Art

Clip-on pot holders comprising a metal clasp which is attached to a post and fitted over and under a pot's lip have been used for supporting up to seven inch diameter pots. Although these clips can support reasonable loads, they are limited in their ability and cannot be protected against failure. Other forms of makeshift supports or shelves have been used to support plants, but none are known which are designed to act in a cantilever manner to support a flower pot from a wall or the edge of a narrow ledge or window sill. Thus, a need exists for a well designed, inexpensive pot holder for attachment to a wall or edge of a window sill in a cantilever manner.

SUMMARY OF THE INVENTION

In accordance with the invention claimed, a new and improved holder is provided for mounting plants on a wall or a window sill.

It is, therefore, one object of this invention to provide a new and improved plant holder.

Another object of this invention is to provide a new and improved flower pot holder for mounting on the side of a wall or the edge of a window sill in a cantilever manner.

A further object of this invention is to provide a new and improved cantilever flower pot support which is secured at only one point on the top of a ledge but transfers a part of the weight of the pot through a non-secured wall bearing arm.

A still further object of this invention is to provide a new and improved flower pot holder for mounting on a wall or the edge of a window sill which is telescopically adjustable to position a support arm against the wall of the building.

A still further object of this invention is to provide an inexpensive holder for supporting plant growth on a wall or a window sill which may be molded from plastics.

Additional objects and advantages of the invention will become apparent as the following description proceeds and the features of novelty which characterize this invention will be pointed out with particularity in the claims annexed to and forming a part of this specification.

Brief Description of the Drawings

The present invention may be more readily described with reference to the accompanying drawings in which:

FIG. 8 is a perspective view of a modification of the cantilever pot holder shown in FIGS. 1-6;

FIG. 9 is a partial perspective view of the back side of FIG. 8 showing the telescopic arrangement of the support arm;

FIG. 10 is a top view of a further modification of the pot holders shown in FIGS. 1 and 8;

FIG. 11 is a side view of the pot holder shown in FIG. 10 illustrating in more detail the base support for the pot;

FIG. 12 is an exploded perspective view of the pot and base support shown in FIGS. 10 and 11;

FIG. 13 is a top view of a still further modification of the pot holder shown in FIGS. 1, 8 and 10;

DESCRIPTION OF THE PREFERRED EMBODIMENT

Figure 1:
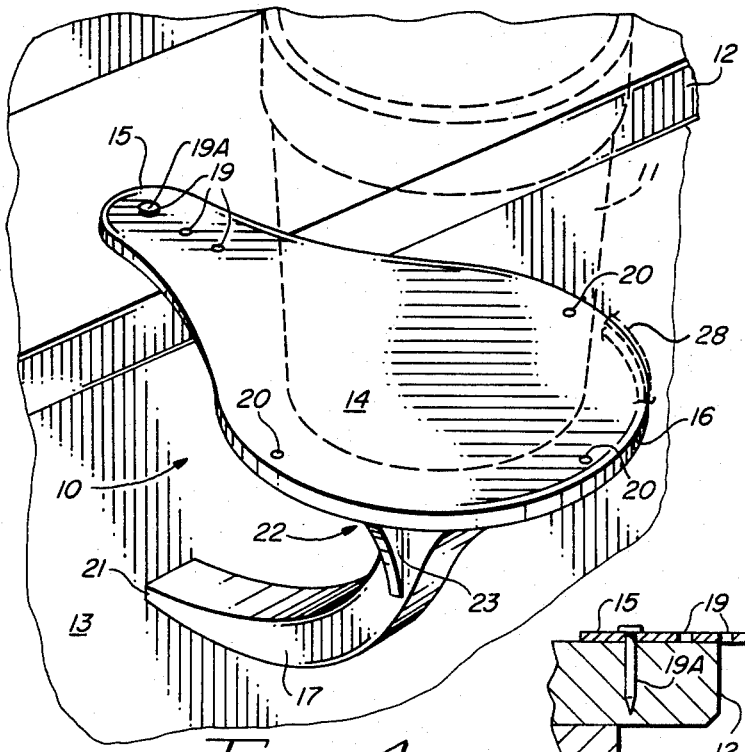
FIG. 1 is a perspective view of a cantilever pot holder mounted on the edge of a sill and embodying the invention.
Figure 5:
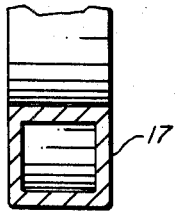
FIG. 5 is a cross-sectional view of FIG. 2 taken along the line 5—5.

Referring more particularly to the drawings by characters of reference, FIGS. 1-6 disclose a support 10 for flower pots 11 or the like, one of which is shown in dash lines in FIG. 1, which may be supported in a cantilever manner from a window sill 12 of a building 13.

Figure 2:
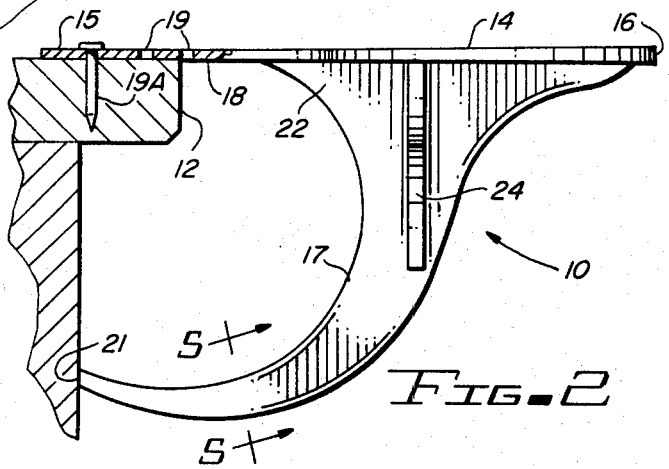
FIG. 2 is a left side view of FIG. 1.
Figure 3:
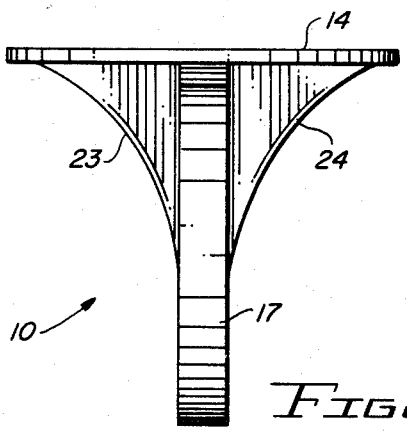
FIG. 3 is a front view of FIG. 1.
Figure 4:
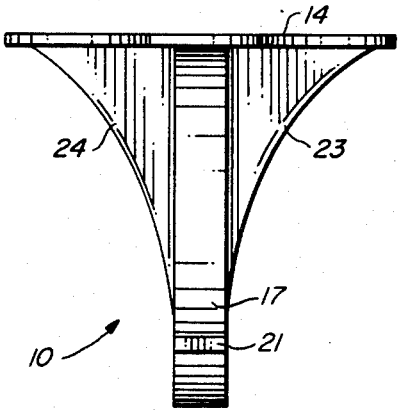
FIG. 4 is a back view of FIG. 1.

Support 10 comprises a flat shelf 14, the top surface of which may be in the form of a teardrop or bicycle saddle or seat design. The thickness of this shelf may taper, if desired, from its nose 15 to a slightly thicker rounded support base 16, as shown in FIG. 2. This taper is intended to compensate for the uneven bases of many flower pots and to aid in keeping the flower pots from sliding off of the shelf. An arcuate leg 17 formed integral with the bottom of shelf 14 extends from its bottom surface 18 thereof in a graceful, curved configuration in the same general direction as nose 15. It should be noted that leg 17 is shorter than nose 15, so that the nose of the shelf may penetrate inwardly of sill 12 a greater distance than leg 17.

As noted from FIG. 1 of the drawings, nose 15 of shelf 14 is provided with a plurality of apertures or holes 19 extending therethrough which are arranged in a row longitudinally of shelf 14, making it possible for the nose to be secured to the sill in one of a number of places along its length by a fastening means such as a bolt or nail 19A. Further, the nose extends inwardly of the edge of sill 12 a sufficient distance so that its leg 17 will and can bear against the vertical wall of building 13 for many different sill configurations. Leg 17 is a load-bearing structure transmitting part of the load of shelf 14 against the vertical wall of building 13 supporting the sill.

Figure 6:
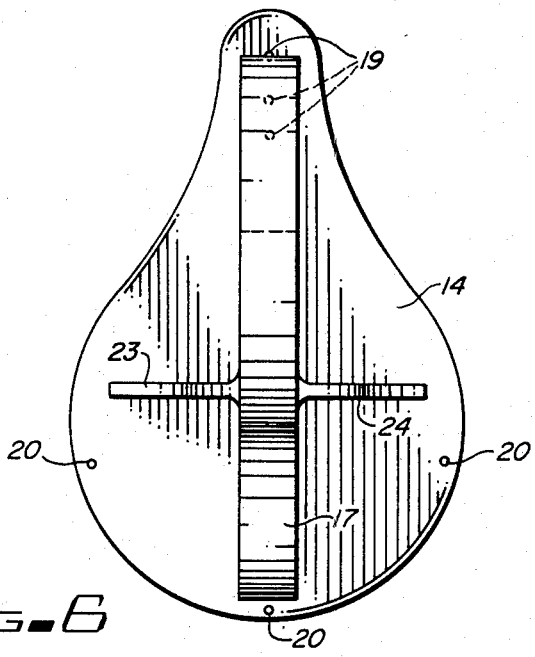
FIG. 6 is a bottom view of FIG. 1.

FIGS. 1 and 6 further illustrate a plurality of apertures or holes 20 spacedly positioned around the edge of shelf 14. These holes are arranged to receive and secure strings or wires that can serve as a trellis for the plant growth in pot 11.

As noted from FIGS. 1–6, leg 17 is illustrated as being a solid configuration tapering from its end 21 toward its shelf supporting end 22 with cross braces 23 and 24 formed integral therewith. This leg configuration may be integral with shelf 14 or separately secured thereto in a suitable manner.

Figure 7:
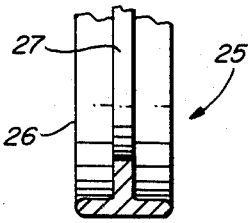
FIG. 7 is a partial view of a modification of the leg bearing member of FIG. 1.

FIG. 7 illustrates a modification of the configuration of leg 17 of FIGS. 1–6 wherein leg 25 comprises a rib design.

This leg is formed in a T-shaped configuration, the bight 26 of which extends around the outside periphery of support 10 with a leg 27 of the T-shaped configuration forming the rib. This type of leg structure is strong and uses less material, such as plastic, in the molding process.

It should be noted that a ridge 28 may be formed around the edge of the top surface of shelf 14 to aid in holding the pots on the shelf, if so desired, and falls within the scope of this invention.

FIGS. 8 and 9 disclose a modification of the cantilever structure shown in FIGS. 1–6 wherein the cantilever structure 30 comprises a flat circular pot holder 31 having a flat surface 32 which is integral with a tab 33 extending laterally therefrom. The tab is provided with a plurality of aligned apertures 34 extending therethrough which serve the same purpose as holes 19 in shelf 14 of FIG. 1.

In place of the leg 17 of FIG. 1, structure 30 is provided with an arm 35 hingedly mounted at one end thereof to an area opposite from tab 33 along the peripheral edge of the circular pot holder 31 of this structure.

Arm 35 further comprises a telescopically mounted extension 36 which slidably moves in a track 37 formed along the underside of arm 35 and is clamped in a given relative position to arm 35 by a wing nut 38 which is threadedly associated with a bolt 39 which is slidably mounted in a slot 40 arranged in and longitudinally of arm 35 in the usual manner.

This arm makes it possible to lengthen or shorten arm 35 so that it may rest against the wall of a building below a sill in the manner discussed above with reference to FIG. 1.

FIG. 10 illustrates a modification of the pot holders of FIGS. 1–9 wherein a clamp 41 is disclosed comprising a U-shaped configuration, the legs 42 and 43 of which are each provided with a plurality of aligned holes 44 which provide a number of positions for mounting the clamp on a window sill 45 by means of bolts or nails 46 in the manner disclosed above under the discussion of FIG. 1.

The bight 47 of the U-shaped configuration of clamp 41 forms an arcuate configuration along its inner periphery 48 for snugly fitting under the ledge 49 of a pot 50.

In order to aid in supporting the weight of pot 50 and its contents, a support arm 51 is provided for clamping on to pegs 52 extending from and either formed integral with the bottom 53 of pot 50 or fixedly attached thereto. These pegs are inserted into selected holes 54 formed in support arm 51 and when so functioning, arm 51 is securely held on pot 50 so as to extend laterally therefrom. The intent is to have support arm 51 extend laterally out from pot 50 a distance sufficient such that it engages the wall of a building below the associated sill in the same way that arm or leg 17 does in FIG. 1 to aid in supporting pot 11 associated therewith.

FIG. 13 discloses a modification of the pot holder or clamp 41 shown in FIGS. 10 and 11 wherein the pot holder or clamp 55 comprises a pair of arms 56 and 57 curved to form an open arcuate configuration, the inner periphery of the legs serving to surround a pot (not shown) under its top ledge in the manner shown in FIGS. 10 and 11. An apertured tab 58 is arranged to extend outwardly of the legs 56 and 57 for attachment to a sill 59 in the manner heretofore described.

Figure 14:
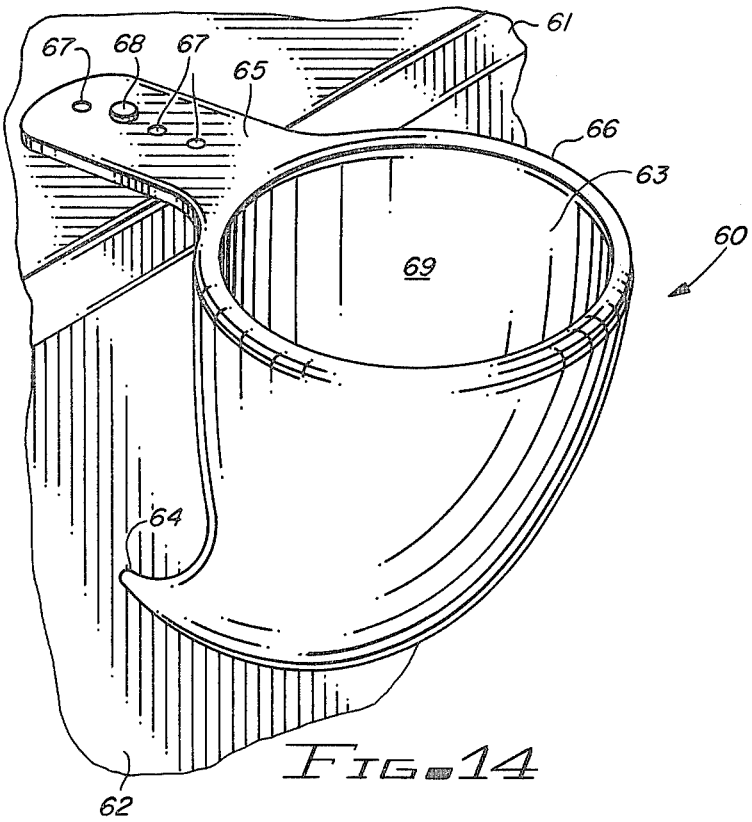
FIG. 14 is a perspective view of a still further modification of the pot holders shown in FIGS. 1-13 wherein the holder comprises a built-in pot container.
Figure 15:
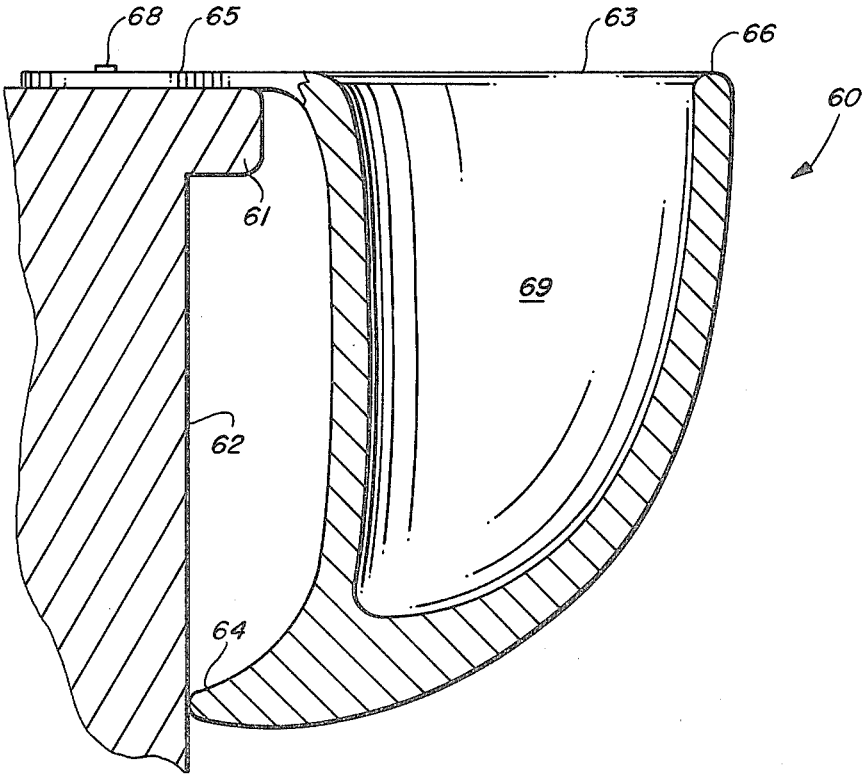
FIG. 15 is a cross-sectional view of FIG. 14.

FIGS. 14 and 15 disclose a structure 60 for supporting plant growth from a window sill 61 of a building 62 wherein the structure may be molded from suitable material such as plastics.

Structure 60 comprises an elongated hollow configuration having a circular opening 63 at one end and tapering to a pointed closed end 64 at its opposite end. The closed end 64 extends laterally of the longitudinal axis of structure 60 to serve as a support arm for structure 60 in the manner as leg 17 of FIG. 1 and support arm 51 of the structure shown in FIGS. 10 and 11.

Structure 60 is provided with a tab 65 integral with and extending laterally from and coplanar with the periphery 66 of the opening 63 formed in structure 60. Tab 65 extends laterally from the periphery 66 of opening 63 in the same direction as its closed end 64.

As noted from FIG. 14, tab 65 is provided with a plurality of aligned holes 67 for receiving a bolt or nail 68 for securing the structure to a sill of a building in the manner heretofore described.

One of the novel features of this structure is that it can hold in its hollow interior 69 potting material (not shown) to support plant growth. Alternately, this structure can support a pot in its hollow interior with the rim of the pot being supported by the peripheral edge 66 of this structure.

FIGS. 16–20 disclose a modification of the flower pot supports shown in FIGS. 1–15 wherein the pot support 70 comprises a flat load-bearing portion or shelf 71 formed in the shape of a paddle. The handle portion 72 of shelf 71, forming a tab means, is provided with one or more holes 73 extending therethrough through which a bolt or nail (not shown) extends to fasten the shelf to a window sill as shown in FIG. 1. The lower surface 74 of shelf 71 is provided with a plurality of spacedly positioned pairs of clamps 75 either formed integral with shelf 71 or suitably attached thereto by glue, cement or the like arranged along the sides of a groove 76 formed in surface 74 to extend longitudinally therefrom, one of each pair on each side thereof. Groove 76 is provided with a serrated surface 77, the notches or teeth 78 of which extend laterally across the width of groove 76 in the manner shown in FIGS. 19 and 20. These teeth are intended to interlock with notches or teeth 79 of the serrated surface 80 formed laterally across the length of the elongated arm 81 of an associated load-bearing portion 82 of the flower pot support 70.

Figure 16:
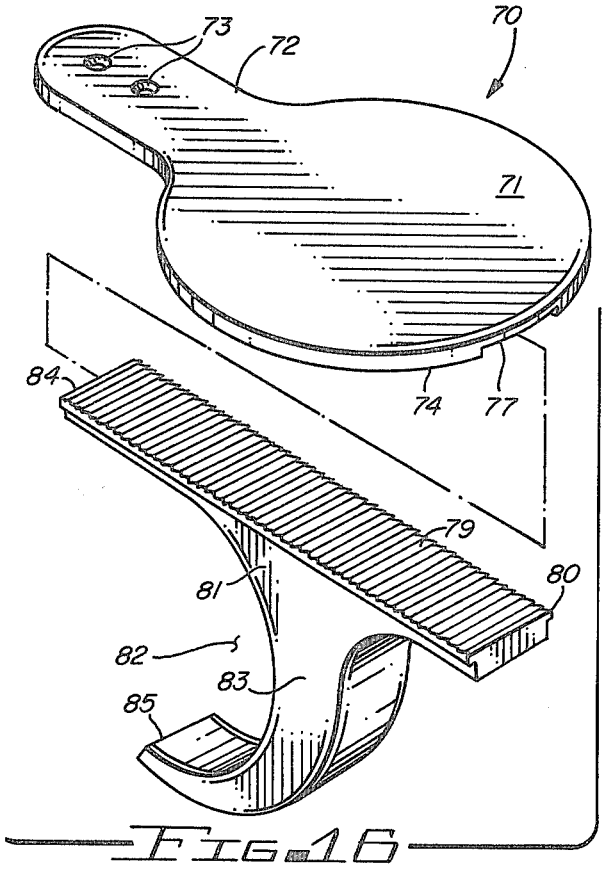
FIG. 16 is an exploded view of a further modification of the pot holders shown in FIGS. 1-15 wherein the supporting arm is telescopically associated with the pot supporting platform.
Figure 19:
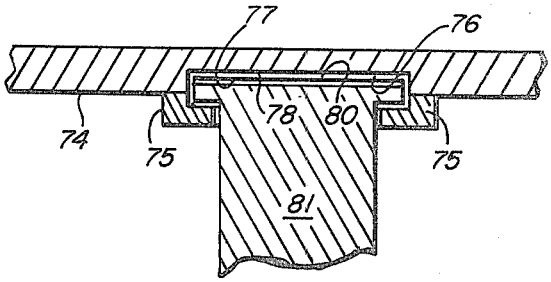
FIG. 19 is a cross-sectional view of FIG. 18 taken along the lines 19—19.
Figure 20:
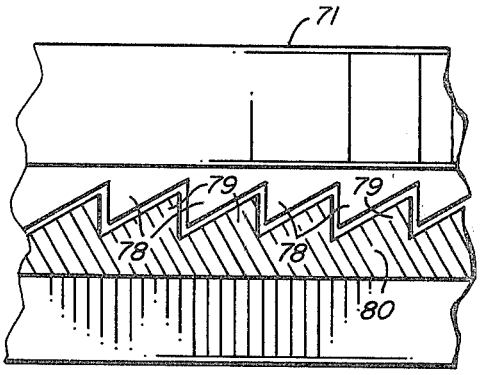
FIG. 20 is an enlargement of the circled area shown in FIG. 18.

Load-bearing portion 82 further comprises an arcuate arm 83 which curves toward the end 84 of the serrated surface 80 which is intended to slide into groove 76 formed in the bottom surface 74 of shelf 71 in the manner shown by the dash lines in FIG. 16.

Figure 17:
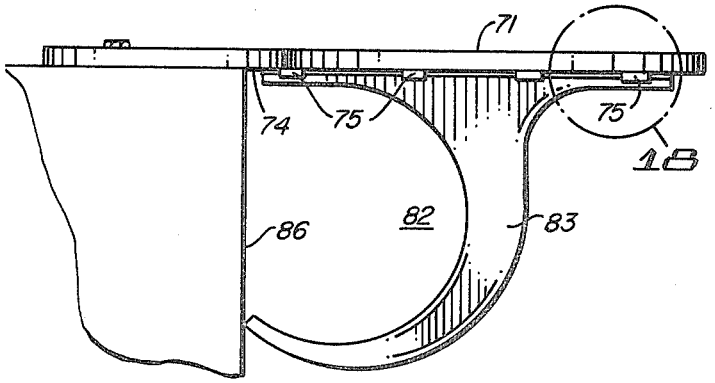
FIG. 17 is a side view of the structure shown in FIG. 16 in assembled relationship.

The distance that the end 84 of the serrated surface 80 penetrates groove 76 is determined by the relative position of shelf 71 on a window sill and the distance that end 84 of the serrated surface 80 penetrates groove 76 to cause end 84 of arm 83 to engage wall 86 of the building below the window sill in the manner heretofore discussed with regard to FIG. 1 and as shown in FIG. 17.

With shelf 71 secured to a window sill and arm portion 82 moved in groove 76 to its desired position relative to shelf 71, the weight of a flower pot supported by the shelf causes the teeth of the serrated portions of groove 76 of shelf 71 and the serrated surface of arm portion 82 to interlock, thereby restricting any further relative movement of these parts as long as the pot remains on the shelf.

Figure 21:
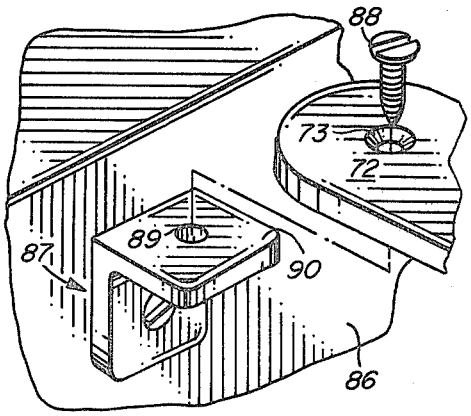
FIG. 21 is an exploded perspective view of a clamp for fastening to the side of a wall for supporting the pot holder shown in FIG. 16.
Figure 18:
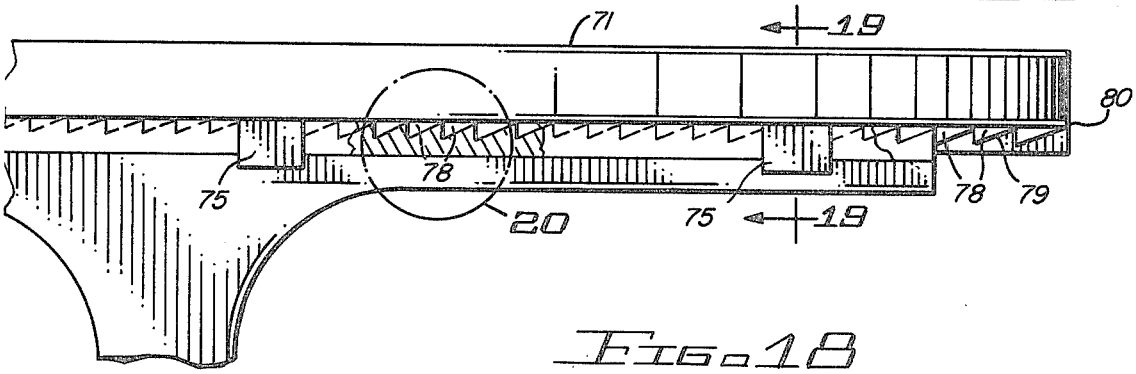
FIG. 18 is an enlargement of the circled area shown in FIG. 17.

FIG. 21 illustrates a right angular clamp 87 which can be fastened to the vertical wall 86 of a building. The clamp is designed to receive a bolt or screw 88 passing through holes 73 in the handle portion 72 of shelf 71 and into a suitable hole 89 in the vertically positioned leg 90 of clamp 87. This arrangement makes it possible to mount the disclosed flower pot support on a vertical surface.

Although but a few embodiments of the invention have been illustrated and described, it will be apparent to those skilled in the art that various changes and modifications may be made therein without departing from the spirit of the invention or from the scope of the appended claims.

What is claimed is:

1. A support for plants comprising:

a flat load-bearing first portion, said first portion having tab means extending laterally therefrom, at least one aperture extending through said tab means for receiving a fastening means for attaching the support to a surface of an object, and a second portion comprising a leg affixed to said first portion and extending laterally therefrom in the same direction as the ends of said tab means, the free end of said leg being provided for engaging the object on which the support is mounted forming a leg-bearing means for said support, said first portion comprising a flat bottom surface with said bottom surface having a groove extending longitudinally thereof toward said tab means, and said second portion comprising an arm slidably extending longitudinally into said groove for positioning said arm at one of a plurality of positions along the length of said first portion, at least a part of the interior of said groove being serrated, and at least a part of said arm that engages the surface of said groove being serrated, whereby when said arm is slidably engaged with said groove, the serrated surfaces of said groove and said arm interlock to hold said first and second portions in a given relative position.

2. The support set forth in claim 1 in further combination with:

a clamp having a pair of right angularly positioned legs for fastening to said object, one of said legs having an apertured surface for engaging with said tab means, and said fastening means extending through said aperture in said tab means and into said apertured surface for attaching the support to a surface of the object.

* * * * *